US007045938B2

(12) United States Patent
Frey et al.

(10) Patent No.: US 7,045,938 B2
(45) Date of Patent: May 16, 2006

(54) REFLECTOR LAMP AND METHOD FOR PRODUCING SUCH A REFLECTOR LAMP

(75) Inventors: Holger Frey, Manching (DE); Georg Rosenbauer, Westheim (DE); Konrad Regler, Hirnstetten (DE); Bernhard Ruhland, Eichstätt (DE); Thomas Sauerer, Beilngries (DE); Anton Würmser, Gelbelsee (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 253 days.

(21) Appl. No.: 10/474,177

(22) PCT Filed: Aug. 7, 2002

(86) PCT No.: PCT/DE02/02899

§ 371 (c)(1),
(2), (4) Date: Oct. 6, 2003

(87) PCT Pub. No.: WO03/054443

PCT Pub. Date: Jul. 3, 2003

(65) Prior Publication Data

US 2004/0130254 A1 Jul. 8, 2004

(30) Foreign Application Priority Data

Dec. 10, 2001 (DE) ..... 101 60 383

(51) Int. Cl.

| | |
|---|---|
| ***H01J 5/16*** | (2006.01) |
| ***H01J 61/40*** | (2006.01) |
| ***H01K 1/26*** | (2006.01) |
| ***H01K 1/30*** | (2006.01) |

(52) U.S. Cl. ..... 313/113; 313/623; 313/634

(58) Field of Classification Search ..... 313/113, 313/115, 578, 623, 624, 634, 318.01, 318.07, 313/318.11

See application file for complete search history.

(56) References Cited

U.S. PATENT DOCUMENTS 5,270,610 A * 12/1993 Schoenherr et al. ... 313/318.01
6,049,169 A * 4/2000 Gibson et al. ..... 313/635

FOREIGN PATENT DOCUMENTS

| | | | |
|---|---|---|---|
| EP | 0 780 884 | | 6/1997 |
| EP | 780884 | A1 * | 6/1997 |
| FR | 2 454 051 | | 11/1980 |
| FR | 2 484 607 | | 12/1981 |
| FR | 2484607 | A * | 12/1981 |

* cited by examiner

*Primary Examiner*—Joseph Williams
*Assistant Examiner*—Kevin Quarterman
(74) *Attorney, Agent, or Firm*—William E. Meyer

(57) ABSTRACT

The invention relates to a reflector lamp and to a method for producing such a reflector lamp, especially a simplified method for fixing the lamp (2) in the reflector (1). The gasket (22) of the lamp base (21) is disposed in the cavity (13) of the reflector neck (12) in such a manner that the at least one power lead (71, 72) projects from the reflector neck (12) through a passage and the lamp base (21) is supported on the inner wall (13) of the reflector (1) perpendicular to the longitudinal axis (A). A fastening element (81, 82) is fastened on the power lead (71, 72) at an angle to the longitudinal axis (A) and rests against the outer wall of the reflector neck (12). The lamp (2) is thus fixated in the reflector (1) in the longitudinal direction (A) without play and without any additional spring elements.

8 Claims, 4 Drawing Sheets

REFLECTOR LAMP AND METHOD FOR PRODUCING SUCH A REFLECTOR LAMP

Figure 1:
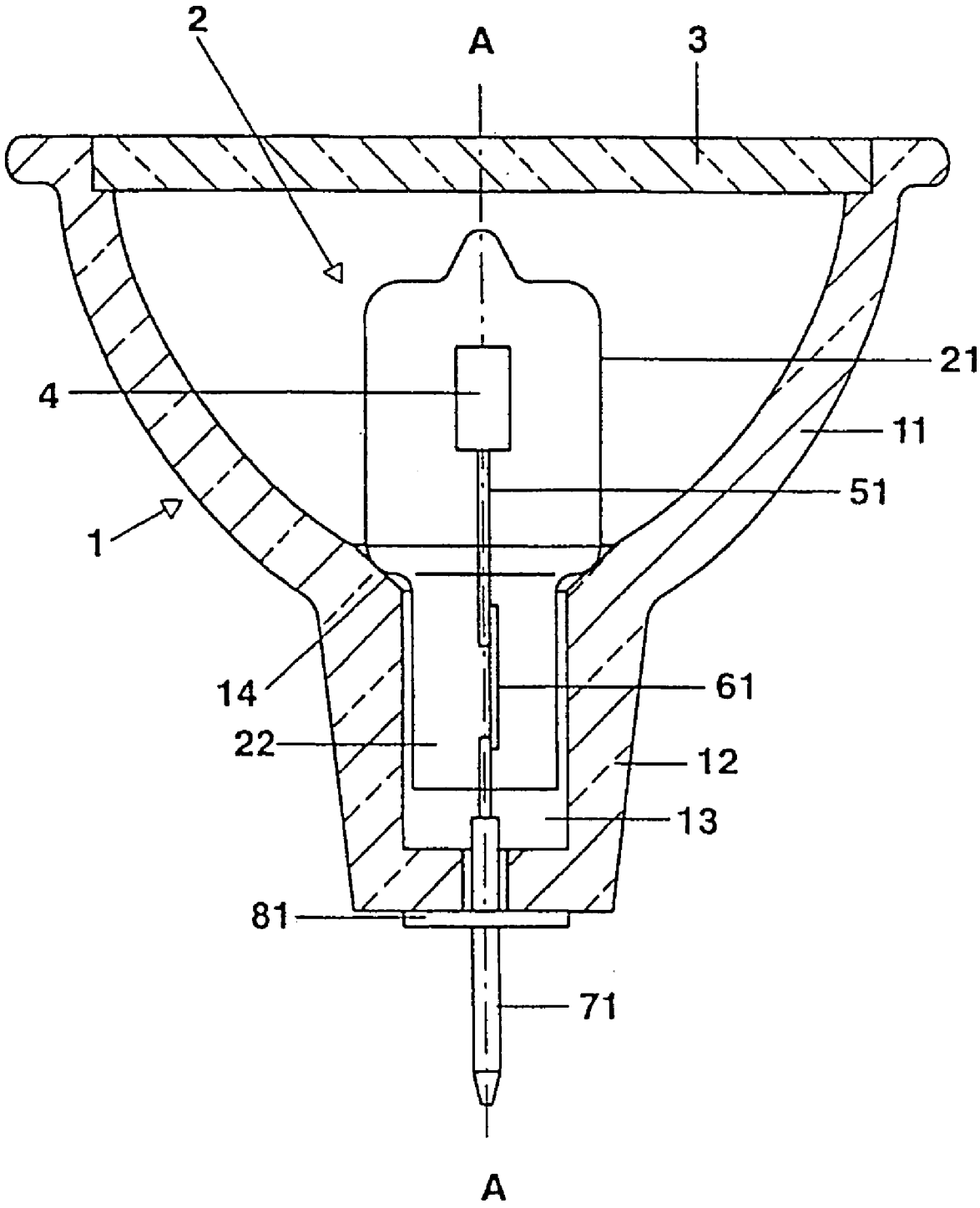

The invention relates to a reflector lamp with a longitudinal axis, which has a reflector and a lamp arranged in the reflector, and to a method for producing such a reflector lamp.

I. PRIOR ART

European patent EP 0 780 884 B1 describes a reflector lamp with a longitudinal axis which has a reflector and a lamp arranged in the reflector. The reflector has a reflector neck that extends in the direction of the longitudinal axis and has a cavity in which the sealed end of the lamp vessel is arranged. In order to fasten the lamp in the reflector, the supply leads projecting from the reflector neck are sheathed in each case with a fastening element that bears against the outer wall of the reflector neck, and there is fastened on the lamp a resiliently designed stamped sheet-metal part, whose spring force acts along the longitudinal axis, and which is supported on the reflector. The resiliently designed stamped sheet-metal part and the aforesaid fastening elements effect an arrangement of the lamp in the reflector that is free from play.

II. SUMMARY OF THE INVENTION

It is the object of the invention to provide a reflector lamp having cost-effective means for fastening the lamp in the reflector. Moreover, the aim is to specify a simplified method for producing a reflector lamp.

This object is achieved according to the invention by means of the features of patent claim 1 and patent claim 7 respectively. Particularly advantageous designs of the invention are described in the dependent claims.

The reflector lamp according to the invention has a longitudinal axis, a reflector and a lamp arranged in the reflector, in which

- the lamp has a lamp vessel that has at least one sealed end extending along the longitudinal axis, the at least one sealed end having, at least in one spatial direction perpendicular to the longitudinal axis, a dimension reduced by comparison with the lamp vessel,
- at least one supply lead for a luminous means arranged inside the lamp vessel projects from the at least one sealed end,
- the reflector has a light exit opening, a light-reflecting part and a reflector neck, which is integrally formed on the light-reflecting part and extends in the direction of the longitudinal axis, the reflector neck being provided with a cavity and at least one bushing for the at least one supply lead,
- the sealed end of the lamp vessel is arranged in the cavity, and the at least one supply lead is guided out of the reflector neck through the at least one bushing,
- the extent of the lamp vessel outside the at least one sealed end is greater than the extent of the cavity in at least one direction perpendicular to the longitudinal axis and
- there is fixed on the section projecting from the reflector neck of the at least one supply lead a fastening element which extends transverse to this supply lead and bears against the outer wall of the reflector neck.

Owing to the combination of the abovenamed features of the reflector lamp according to the invention, the lamp can be fastened without play in the reflector without using additional spring elements in the longitudinal direction.

Contributing to this end are, in particular, the fastening element fixed to the at least one supply lead and extending transverse to this supply lead, as well as the lamp vessel, which is wider by comparison with the sealed end and the cavity, which are supported on the reflector. The fastening element fixed on the at least one supply lead is preferably designed as a wire arranged transverse to the supply lead, or as an annular disc with a disc surface extending perpendicular to the at least one supply lead. In order to permit the lamp to be fixed free from play perpendicular to the longitudinal axis of the reflector lamp, as well, the cavity of the reflector neck, in which the pinch seal of the lamp vessel is arranged, or/and the light-reflecting part of the reflector is/are advantageously conically expanded in the direction of the light exit opening of the reflector. This measure ensures that upon insertion of the pinch seal into the cavity of the reflector neck, the lamp vessel bears against the conically designed inner wall of the reflector neck or of the reflecting part of the reflector and is supported laterally, that is to say, perpendicular to the longitudinal axis. In addition or as an alternative, the dimensions of the cavity in the reflector neck can also [lacuna] coordinated in a fitting fashion with the corresponding dimensions of the pinch seal, in order to achieve lateral support of the lamp in the reflector. In order further to improve the fastening of the lamp in the reflector, the dimensions of the at least one bushing in the reflector neck are advantageously coordinated in a fitting fashion with the thickness of the at least one supply lead.

The method according to the invention for producing the abovedescribed reflector lamp is distinguished in that the following steps are executed in order to fasten the lamp in the reflector:

- the prefabricated lamp is inserted in the longitudinal direction into the prefabricated reflector via the light exit opening of the reflector by inserting the at least one sealed end of the lamp vessel so far into the cavity of the reflector neck that the lamp vessel is seated on the reflector, and
- there is welded onto the at least one supply lead projecting from the bushing of the reflector neck of the lamp a fastening element which extends transverse to this supply lead and bears against the outer wall of the reflector neck.

This method permits the lamp to be fastened cost-effectively in the reflector, since additional spring elements for supporting the lamp are dispensed with. Fixing the fastening element on the at least one supply lead is advantageously carried out by welding by means of a LASER. This method is therefore particularly cost-effective.

III. DESCRIPTION OF THE PREFERRED EXEMPLARY EMBODIMENTS

Figure 2:
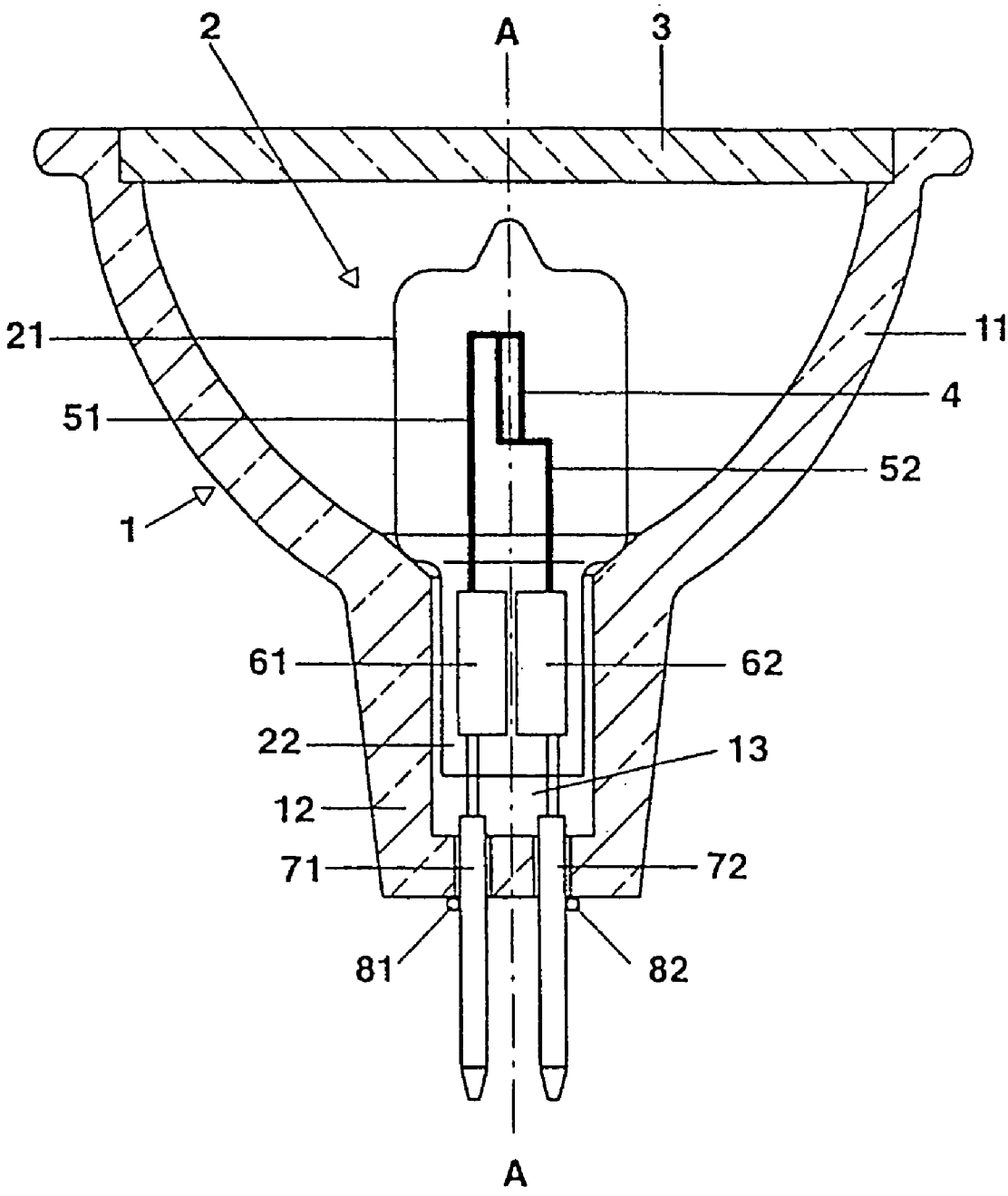
Figure 3:
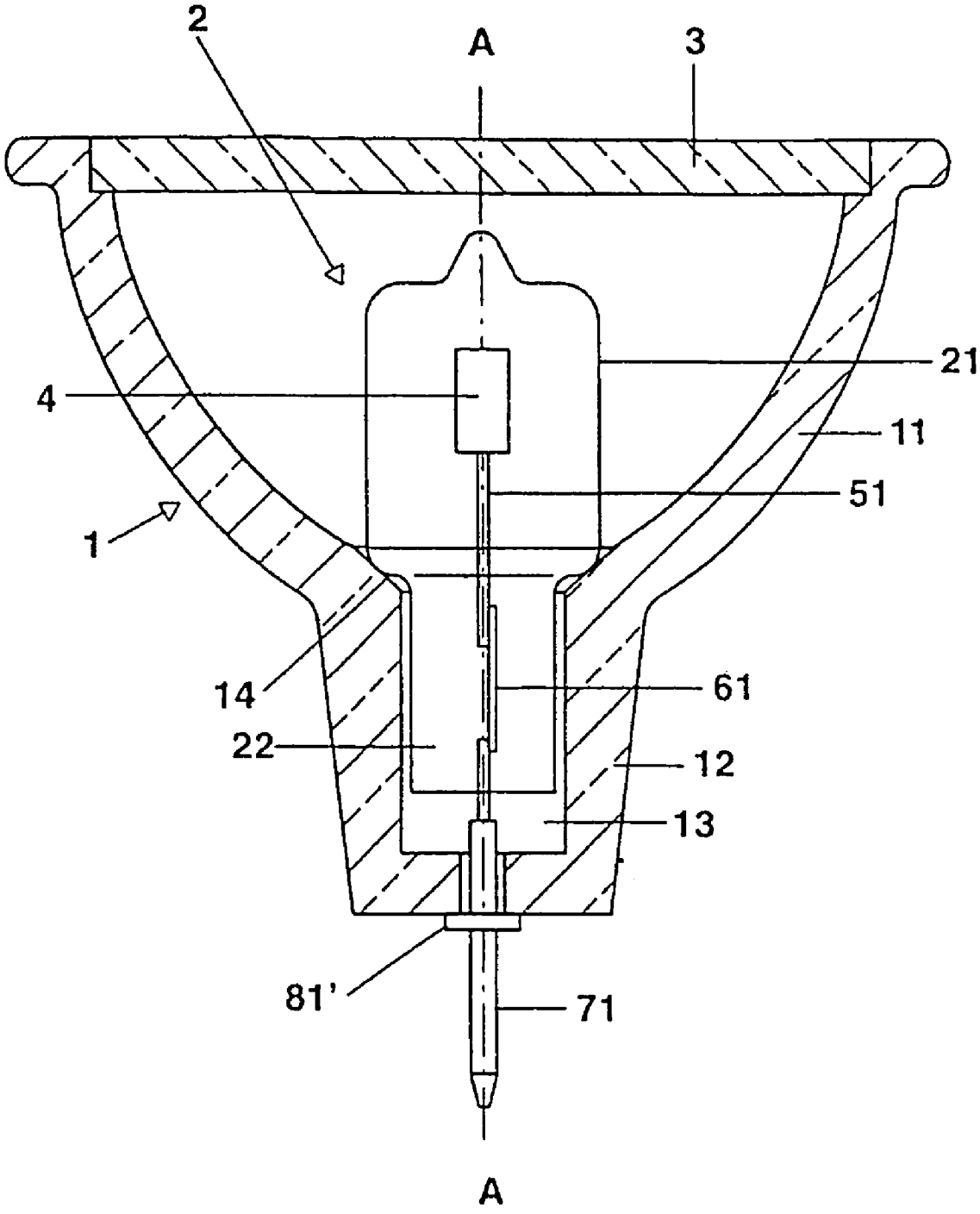
Figure 4:
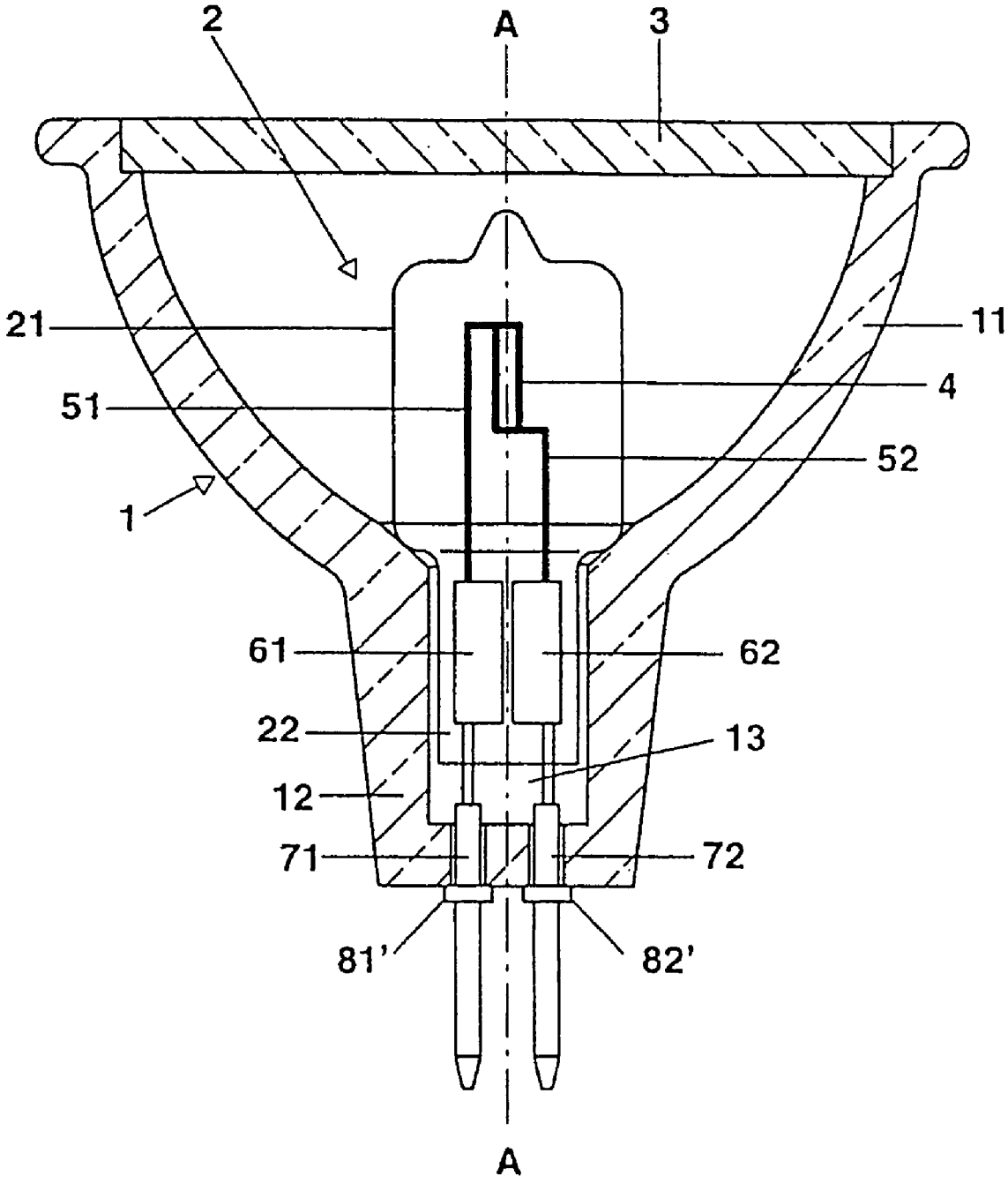

The invention is explained in more detail below with the aid of two preferred exemplary embodiments. In the drawings:

FIG. 1 shows a partially sectioned, schematic side view of a reflector lamp in accordance with a first preferred exemplary embodiment of the invention, FIG. 2 shows the reflector lamp depicted in FIG. 1 in a side view rotated by 90 degrees by comparison with FIG. 1, FIG. 3 shows a partially sectioned, schematic side view of a reflector lamp in accordance with the second preferred embodiment of the invention, and FIG. 4 shows the reflector lamp depicted in FIG. 3 in a side view rotated by 90 degrees by comparison with FIG. 3.

The exemplary embodiment of the invention depicted in FIGS. 1 and 2 is a reflector lamp that is provided with a pin base of type GU5.3 and has an electric power consumption of approximately 50 W. This reflector lamp has a reflector 1 made from glass and a low voltage halogen incandescent lamp 2 fastened therein. The reflector 1 has a rotationally symmetrical light-reflecting part 11 that substantially has the shape of a spherical cap and whose light exit opening is sealed by means of a transparent plate 3 made from glass or plastic. Integrally formed on the light-reflecting part 11 of the reflector 1 is the reflector neck 12 that extends along the axis of symmetry of the spherical cap 11. The axis of symmetry of the spherical cap 11 also forms the longitudinal axis A of the reflector lamp. The inner wall of the spherical cap 11 is designed to reflect light.

The low voltage halogen incandescent lamp 2 fastened in the reflector 1 has a vitreous lamp vessel 21 having an end 22 that is sealed in a gastight fashion and [lacuna] as a pinch seal 22. A luminous means 4, in particular an incandescent filament 4 consisting of tungsten wire, is enclosed in the lamp vessel 21. The ends of the incandescent filament 4 are respectively connected to an inner supply lead 51, 52 that is produced from molybdenum wire and are respectively connected for their part to an outer supply lead 71, 72 via a molybdenum foil 61, 62 embedded in a gastight fashion in the pinch seal 22. The outer supply leads 71, 72 project from the pinch seal 22. Their ends, welded to the molybdenum foil 61, 62, consist of molybdenum, while their ends guided out of the pinch seal 22 are designed as nickel pins or stainless steel pins or as nickelized stainless steel pins.

The halogen incandescent lamp 2 is aligned axially in the reflector 1. The pinch seal 22 is arranged in a cavity 13 of the reflector neck 12 such that the two outer supply leads 71, 72 each extend outwards through a bushing in the bottom of the reflector neck 12. In the spatial direction perpendicular the longitudinal axis A and to the plane of the molybdenum foils 61, 62, the lamp vessel 21 has a greater extent than the pinch seal 22 and than the cavity 13 of the reflector neck 12. The cavity 13 has a conically expanded transition region in this spatial direction at its end facing the light exit opening 3. The lamp vessel 21 bears against the inner wall 14 of the reflector neck 12 in this transition region. The outer supply leads 71, 72 projecting from the reflector neck 12 are respectively welded with the aid of a wire 81, 82 that is made from stainless steel and is arranged perpendicular to the respective supply lead 71 or 72 and bears against the outer wall of the reflector neck 12. Since the lamp vessel 21 is seated on the reflector 1 at the end of the reflector neck 12 facing the light exit opening 3, and the wires 81, 82 bear against the outer wall of the reflector neck 12, the halogen incandescent lamp 2 is fixed in the reflector 1 without play in the direction of the longitudinal axis A. On the basis of the conically designed transition region 14, the halogen incandescent lamp 2 is fixed without play in the reflector 1 perpendicular to the longitudinal axis A, as well.

In order to produce the reflector lamp, the low voltage halogen incandescent lamp 2 prefabricated using the customary method is inserted into the reflector 1, likewise prefabricated using a known method, via the open light exit opening such that the pinch seal 22 is arranged in the cavity 13 of the reflector neck 12, and the outer supply leads 71, 72 project outwards through the bushings in the bottom of the reflector neck 12. The pinch seal 22 is inserted so far into the cavity 13 that the lamp vessel 21 is seated on the inner wall 14 of the conically expanded transition region of the cavity 13 or the reflector neck 12. In this position, the lamp 2 and the reflector 1 are fixed in a holding device (not depicted). Subsequently, a LASER is used to weld the wires 81, 82, aligned transverse to the outer supply leads 71, 72, to the supply leads 71, 72, respectively, specifically such that the wires bear against the outer wall of the reflector neck 12 or against the bottom of the reflector neck 12. Thereafter, the wires 81, 82 are shortened to the desired length with the aid of the LASER. The holding device for the lamp 2 and the reflector 1 is now removed. Finally, the cover plate 3 for the light exit opening of the reflector 1 is mounted.

In accordance with the second exemplary embodiment of the invention, instead of the wires 81, 82 use is made as fastening elements of two annular discs 81', 82' consisting of a metal—for example of stainless steel. In all other details, the reflector lamp in accordance with the second exemplary embodiment corresponds to the reflector lamp described above. For this reason, the same reference numerals are used in FIGS. 3 and 4 for identical parts as in FIGS. 1 and 2 of the first exemplary embodiment. Threaded onto each of the two outer supply leads 71, 72 is an annular discs 81', 82' such that the disc surfaces are arranged perpendicular to the respective outer supply lead 71, 72, respectively, and rest on the outer wall of the reflector neck 12. After being threaded on, these discs 81', 82' are welded to the corresponding outer supply lead 71 or 72, respectively. The inner diameter of the annular discs 81', 82' is coordinated with the thickness of the supply leads 71, 72. By virtue of the fact that the lamp vessel 21 rests on the inner wall 14 of the conically expanded transition region of the cavity 13 or of the reflector neck 12, and that the discs 81', 82' bear against the outer wall of the reflector neck 12, the lamp is mounted without play in the axial direction of the reflector 1.

The invention claimed is:

1. A reflector lamp with a longitudinal axis (A) comprising:

a glass reflector (1) and a lamp (2) arranged in the reflector (1), in which the lamp (2) has a lamp vessel (21) that has at least one sealed end (22) extending along the longitudinal axis (A), the at least one sealed end (22) having, at least in one spatial direction perpendicular to the longitudinal axis (A), a dimension reduced by comparison with the lamp vessel (21), at least one supply lead (71, 72) for a luminous means (4) arranged inside the lamp vessel (21) the supply lead projecting from the at least one sealed end (22), the reflector (1) having a light exit opening, a light-reflecting part (11) and a reflector neck (12), which is integrally formed on the light-reflecting part (11) and extends in the direction of the longitudinal axis (A), the reflector neck (12) being provided with a cavity (13) and at least one bushing for the at least one supply lead (71, 72), the sealed end (22) of the lamp vessel (21) being arranged in the cavity (13), and the at least one supply lead (71, 72) being guided out of the reflector neck (12) through the at least one bushing, the extent of the lamp vessel (21) outside the at least one sealed end (22) being greater than the extent of the cavity (13) in at least one direction perpendicular to the longitudinal axis (A) to bear against the reflector, and there being fixed on the section projecting from the reflector neck of the at least one supply lead (71, 72) a fastening element (81, 82; 81', 82') which extends transverse to this supply lead (71, 72) and bears against the outer wall of the reflector neck (12).

2. The reflector lamp as claimed in claim 1, wherein the fastening element is a wire (81, 82) arranged transverse to the at least one supply lead (71, 72).

3. The reflector lamp as claimed in claim 1, wherein the fastening element is an annular disc (81', 82') with a disc surface extending perpendicular to the at least one supply lead (71, 72).

4. The reflector lamp as claimed in claim 1, wherein the reflector (1) is designed in a conically expanded fashion in the direction of the light exit opening.

5. The reflector lamp as claimed in claim 1, wherein the dimensions of the at least one bushing are coordinated in a fitting fashion with the thickness of the section, arranged in the at least one bushing, of the at least one supply lead (71, 72).

6. The reflector lamp as claimed in one of claim 1, wherein the at least one sealed end (22) is arranged in a fitting fashion in the cavity (13).

7. A method for producing a reflector lamp having the features of claim 1, comprising the following steps:

inserting the prefabricated lamp (2) in the longitudinal direction (A) into the prefabricated reflector (1) via the light exit opening of the reflector (2) by inserting the at least one sealed end (22) of the lamp vessel (21) so far into the cavity (13) of the reflector neck (12) that the lamp vessel (21) is seated on the reflector (1), and welding onto the at least one supply lead (71, 72) projecting from the bushing of the reflector neck (12) of the lamp (2) a fastening element (81, 82; 81', 82') which extends transverse to this supply lead and bears against the outer wall of the reflector neck (12).

8. The method as claimed in claim 7, wherein the fastening element (81, 82; 81', 82') is welded onto the at least one supply lead (71, 72) by means of a LASER.

* * * * *